US009375783B2

(12) United States Patent
Karg et al.

(10) Patent No.: US 9,375,783 B2
(45) Date of Patent: Jun. 28, 2016

(54) DISCONTINUOUS SHORT FIBER PREFORM AND FIBER-REINFORCED ALUMINUM BILLET AND METHODS OF MANUFACTURING THE SAME

(75) Inventors: Karin M. Karg, Waltham, MA (US); Justin Andreas Neutra, Marlborough, NH (US); Jeff Parnell, Chelmsford, MA (US); James Gorman, Boxborough, MA (US)

(73) Assignee: Triton Systems, Inc., Chelmsford, MA (US)

( * ) Notice: Subject to any disclaimer, the term of this patent is extended or adjusted under 35 U.S.C. 154(b) by 415 days.

(21) Appl. No.: 13/153,145

(22) Filed: Jun. 3, 2011

(65) Prior Publication Data

US 2011/0300378 A1 Dec. 8, 2011

Related U.S. Application Data

(60) Provisional application No. 61/351,723, filed on Jun. 4, 2010.

(51) Int. Cl.
*B22D 19/14* (2006.01)
*C22C 32/00* (2006.01)
(Continued)

(52) U.S. Cl.
CPC ..... *B22D 19/14* (2013.01); *C22C 32/0089* (2013.01); *C22C 47/06* (2013.01); *C22C 47/08* (2013.01); *C22C 49/06* (2013.01); *Y10T 428/2913* (2015.01)

(58) Field of Classification Search
CPC ..... B22D 19/14; C22C 47/06; C22C 47/08; Y10T 428/2913
USPC ..... 428/364; 264/19
See application file for complete search history.

(56) References Cited

U.S. PATENT DOCUMENTS 4,469,757 A 9/1984 Ghosh et al.
4,777,014 A 10/1988 Newkirk et al.
(Continued)

FOREIGN PATENT DOCUMENTS

JP 05-311276 * 11/1993

OTHER PUBLICATIONS

International Search Report and Written Opinion dated Nov. 15, 2011 for PCT/US2011/039141.
(Continued)

*Primary Examiner* — Jennifer Chriss
*Assistant Examiner* — Camie Thompson
(74) *Attorney, Agent, or Firm* — Pepper Hamilton LLP

(57) ABSTRACT

Discontinuous fiber preforms, fiber-reinforced metal matrix composites, and methods of making same are disclosed. A fiber preform includes a milled fiber material having a weighted average fiber length of about 0.03 mm to 0.12 mm and/or a percent fiber volume fraction of the fiber preform of about 15% to about 55%. The milled fiber material is at least substantially free of a binder material. A fiber-reinforced MMC includes a milled fiber material having a weighted-average fiber length of about 0.03 mm to 0.12 mm and/or a percent fiber volume fraction of the fiber preform of about 15% to about 55%. The fiber-reinforced MMC further includes a metal infiltrated into the milled fiber material. The milled fiber material is at least substantially free of a binder material. The milled fiber can be substantially uniformly oriented and/or randomly oriented in the fiber preform and/or the fiber-reinforced MMC.

19 Claims, 12 Drawing Sheets

(51) Int. Cl.

| | |
|---|---|
| ***C22C 47/06*** | (2006.01) |
| ***C22C 47/08*** | (2006.01) |
| ***C22C 49/06*** | (2006.01) |

(56) References Cited

U.S. PATENT DOCUMENTS

| | | | | | |
|---|---|---|---|---|---|
| 4,810,419 | A | | 3/1989 | Kunimoto et al. | |
| 5,108,964 | A | * | 4/1992 | Corbett et al. | 501/89 |
| 5,205,398 | A | * | 4/1993 | Hart et al. | 198/780 |
| 5,259,436 | A | | 11/1993 | Yun et al. | |
| 5,511,603 | A | | 4/1996 | Brown et al. | |
| 5,552,008 | A | | 9/1996 | Hecht et al. | |
| 5,570,502 | A | | 11/1996 | Sawtell et al. | |
| 5,607,523 | A | | 3/1997 | Masumoto et al. | |
| 5,616,421 | A | | 4/1997 | Sawtell et al. | |
| 5,630,974 | A | | 5/1997 | Rose et al. | |
| 5,702,542 | A | | 12/1997 | Brown et al. | |
| 5,744,734 | A | * | 4/1998 | Yang et al. | 75/249 |
| 5,746,267 | A | | 5/1998 | Yun et al. | |
| 5,750,058 | A | | 5/1998 | Hecht et al. | |
| 5,775,403 | A | | 7/1998 | Premkumar et al. | |
| 5,865,238 | A | | 2/1999 | Carden et al. | |
| 6,003,221 | A | | 12/1999 | Sawtell et al. | |
| 6,098,700 | A | | 8/2000 | Carden et al. | |
| 6,309,703 | B1 | | 10/2001 | Wapner et al. | |
| 6,432,536 | B1 | | 8/2002 | Hecht et al. | |
| 6,476,343 | B2 | | 11/2002 | Keicher et al. | |
| 6,706,401 | B1 | | 3/2004 | Wapner et al. | |
| 6,756,112 | B1 | | 6/2004 | Wapner et al. | |
| 6,864,297 | B2 | | 3/2005 | Nutt et al. | |
| 7,288,133 | B1 | | 10/2007 | Peng et al. | |
| 8,043,703 | B2 | * | 10/2011 | Cornie et al. | 428/408 |
| 2002/0190409 | A1 | | 12/2002 | Burdsall et al. | |
| 2003/0164206 | A1 | | 9/2003 | Cornie et al. | |

OTHER PUBLICATIONS

Carreno-Morelli, "Interface Stress Relaxation in Metal Matrix Composites," Materials Science Forum, 2001, pp. 570-580, vols. 366-368, Mechanical Spectroscopy 2001, Trans Tech Publications, Switzerland.

Chawla, et al., "Metal-Matrix Composites in Ground Transportation," JOM, Journal of the Minerals, Metals and Materials Society, 2006, pp. 67-70, vol. 58, No. 11, Springer, New York, NY.

Harris, S.J., "Cast Metal Matrix Composites," Materials Science and Technology, Mar. 1988, vol. 4, No. 3, pp. 131-239, Maney Publishing.

Li, et al., "Theoretical and Experimental Study on Ultrasonic Cavitation Based Solidification Processing of Bulk Aluminium Matrix Nanocomposite," American Foundry Society Transactions, 2007, pp. 1-12, Paper #07-113.

Merle, P., "Thermal Treatments of Age-Hardened Metal Matrix Composites," MMC-Assess Thematic Network, MMC-Assess Consortium, Aug. 2000, vol. 2, pp. 1-24, available at http://mmc-assess.tuwien.ac.at/public/v2_thermaltreat.pdf, Institute of Materials Science and Testing—Vienna University of Technology, Vienna, Austria.

Saffil Automotive Data Sheet, "Properties of Metal Matrix Composites," Saffil Ltd., Cheshire, UK.

Thermal Ceramics Datasheet, "Preforms for Metal Matrix Composites. Wear Resistant Fibralloy™ Reinforced Composites," Jan. 1998, Thermal Ceramics Transportation, Plymouth, Michigan.

Tavangar, et al., "Damage Evolution in Saffil Alumina Short-Fibre Reinforced Aluminum During Tensile Testing," Materials Science and Engineering A, 2005, vol. 395, pp. 27-34, Elsevier B.V.

Weiss, et al., "Enabling Technology for the Design of Short-Fiber Reinforced Aluminum MMC Components," Society of Automotive Engineers, Inc., 2001, Paper No. 2003-01-0827, SAE International, Warrendale, Pennsylvania.

Weiss, et al, Extension of "Enabling Technology for the Design of Short-Fiber Reinforced Aluminum MMC Components," Paper No. 2003-01-0827, Society of Automotive Engineers, Inc., Oct. 14, 2004, SAE International, Warrendale, Pennsylvania.

Wessel, J. K., "Continuous Fiber Ceramic Composites," Handbook of Advanced Materials: Enabling New Designs, 2004, Chapter 3, 89-128, John Wiley & Sons, Inc., Hoboken, NJ, USA.

* cited by examiner

DISCONTINUOUS SHORT FIBER PREFORM AND FIBER-REINFORCED ALUMINUM BILLET AND METHODS OF MANUFACTURING THE SAME

RELATED APPLICATIONS

This application claims the benefit of and priority to U.S. Provisional Application No. 61/351,723, entitled "Discontinuous Short Fiber Preform and Fiber-Reinforced Aluminum Billet and Methods of Manufacturing the Same," filed on Jun. 4, 2010, which is hereby incorporated herein by reference.

GOVERNMENT RIGHTS

This invention was developed with Government support under Contract No. N68335-09-C-0063 awarded by the Department of the Navy, Naval Air Warfare Center (NAVAIR). The Government has certain rights in the invention.

FIELD OF INVENTION

The present invention generally relates to metal matrix composites. More specifically, the present invention relates to fiber-reinforced preforms and metal infiltrated billets and methods of making the same.

BACKGROUND

Metal Matrix Composites (MMCs) are composed of a metal or metal composite and a reinforcement material, which, in combination, provide enhanced mechanical performance at a fraction of the weight compared to conventional metals and metal composites. The reinforcement material typically has a higher Young's modulus and ultimate tensile strength than the corresponding metal or metal composite to increase the effective strength and other physical and mechanical properties of the MMC. An example of a MMC is a fiber-reinforced metal (e.g., fiber-reinforced aluminum). Fiber reinforced metals, such as fiber-reinforced aluminum ("FRA"), can be used as a lighter-weight and/or a higher performance replacement for aluminum alloys, low alloy steels, including hardened or carburized steel, titanium, and other structural or wear-resistant alloys. For example, FRA can be used in bearing liners, bushings or inserts, aerospace or automobile structural parts, pistons, reciprocating and/or rotating components, robot and/or high-speed machine parts, or brakes.

MMCs can be classified according to whether the reinforcement material is continuous (e.g., monofilament or multifilament) or discontinuous (e.g., particle, whisker, or short fiber). One type of metal for MMCs is aluminum and its alloys. Other types of metals include magnesium, titanium, copper, zinc and lead.

Continuous reinforcement structures include wires and/or fibers, formed out of materials such as alumina, boron, tungsten, steel, carbon fiber or silicon carbide. While continuous MMCs generally have superior mechanical properties as compared to discontinuous MMCs, continuous MMCs are generally anisotropic materials (i.e., their properties vary widely with direction). Anisotropic materials have a disadvantage for use in many wear applications or strength components having complex geometries or loadings. Additionally, continuous MMCs are generally more expensive to manufacture than discontinuous MMCs.

Discontinuous reinforcement structures include particles, "whiskers," and/or short fibers, typically formed out of ceramic-based materials such as alumina, alumina silica, or silicon carbide. Discontinuous MMCs can be isotropic (i.e., their properties do not vary with direction) or anisotropic and are generally less expensive to manufacture than continuous MMCs. Discontinuous MMCs generally have inferior mechanical properties in some directions as compared to continuous MMCs in the direction of reinforcement.

MMCs can be manufactured by infusing a metal or metal composite into a preform of continuous or discontinuous reinforcement material. The preform can be in a variety of shapes, including a cylinder, sphere, parallelpiped, or any other shape that may be related to the ultimate shape of the MMC material application (e.g., automobile structural part, piston, bushing, etc.). A known method of creating a preform is to combine the reinforcement material (e.g., short fibers) with an inorganic binder material (e.g., colloidal silica) to set the reinforcement material into the shape of the preform. The preform is then infused with molten metal (e.g., aluminum) to form a MMC (e.g., a discontinuous fiber FRA) billet. The MMC billet can then be machined into a desired shape.

A known problem with adding a binder material to a discontinuous reinforcement material (e.g., short fibers) to create a preform is the binder material weakens the mechanical properties of the MMC (e.g., discontinuous FRA) billet by adding a contaminant to the reinforcement material. For example, the binder can increase the brittleness of the MMC billet (e.g., by locking the reinforcement material in place) and/or make the preform less resistant to dimensional changes as a result of thermal stresses. Additionally, the binder material adds an additional expense to the MMC and preform manufacturing processes. Degradation of the binder in the metal infiltration step may also introduce porosity or other defects in the resulting MMC component.

A known problem with discontinuous preforms is the distribution of length and orientation of the reinforcement material (e.g., short fibers) may not be uniform, which can cause defects in the resulting MMC billet. Yet another known problem with preforms is the inability to achieve a wide range of reinforcement volume fractions due to stability/integrity issues at low and high volume fractions.

A known problem with MMC materials containing particle or continuous fiber reinforcement materials is they are difficult to machine into a desired shape. For example, these MMCs can have poor surface finishes because increased machining forces are typically required due to the hardness of the reinforcement material. In addition, particulate reinforcement may be randomly dislodged from the machined surface, resulting in poor surface finishes. This behavior is not observed with FRA manufactured with discontinuous fibers, where surface finishes of less than about 32 μin, a roughness average (Ra) of about 0.8 μm or less, and/or an arithmetic average roughness height (AA) of about 32 μin or less can be easily obtained.

SUMMARY

Accordingly, it is desirable to manufacture a preform without using a binder material. It is also desirable to manufacture preforms with a substantially uniform length distribution and/or orientation of reinforcement material. It is also desirable to manufacture preforms with the ability to achieve a wide range of reinforcement volume fractions. It is also desirable to manufacture discontinuous preforms and MMC billets that have a substantially uniform short-fiber distribution and/or orientation. It is also desirable to manufacture discontinuous MMC billets that can be conventionally machined (e.g., machined to a surface finish less than about 32 μin, Ra of about 0.8 μm or less, and/or an AA of about 32 μin or less).

An aspect of the technology includes a fiber preform. The fiber preform includes a milled fiber material having a weighted average fiber length of about 0.03 mm to about 0.12 mm. The fiber preform is at least substantially free of a binder material. In some embodiments, the weighted-average fiber aspect ratio is correlated to a percent fiber volume fraction of the fiber preform. The milled fiber material can include a ceramic and can include alumina silicate. The milled fiber can be substantially uniformly oriented and random in the fiber preform.

Another aspect of the technology includes a fiber preform. The fiber preform includes a milled fiber material having a percent fiber volume fraction of the fiber preform of about 15% to about 55%. The fiber preform is at least substantially free of a binder material. In some embodiments, a weighted-average fiber aspect ratio is correlated to the percent fiber volume fraction of the fiber preform. The milled fiber material can include a ceramic and can include alumina silicate. The milled fiber can be substantially uniformly oriented and random in the fiber preform.

Yet another aspect of the technology includes a method of manufacturing a discontinuous fiber preform. The method includes mixing a milled fiber material and a polar solvent to form a slurry, wherein the slurry is at least substantially free of a binder material. The method further includes pouring the slurry into a mold tooling, filtering the slurry to retain the milled fiber material in the mold tooling, and evaporating the remaining polar solvent from the milled fiber material.

In some embodiments, the slurry comprises about 1 to about 40 parts of the polar solvent to about 1 part of milled fiber material. In some embodiments, the milled fiber material has a weighted-average fiber length of about 0.03 mm to about 0.12 mm. In some embodiments, a discontinuous fiber preform is manufactured by the method described above. The milled fiber material can include a ceramic and can include alumina silicate. The polar solvent can include a polar organic solvent. The method can include substantially uniformly distributing the milled fiber in the discontinuous fiber preform.

Yet another aspect of the technology is a method of manufacturing a discontinuous fiber-reinforced MMC. The method includes mixing a milled fiber material and a polar solvent to form a slurry, wherein the slurry is at least substantially free of a binder material. The method further includes pouring the slurry into a mold tooling and filtering the slurry to retain the milled fiber material in the mold tooling. The method further includes evaporating the remaining polar solvent from the milled fiber material, thereby creating a discontinuous preform and pressure-infiltrating the preform with a metal. The method can include substantially uniformly distributing the milled fiber in the fiber-reinforced MMC.

In some embodiments, the metal is an A201 aluminum alloy. In some embodiments, the slurry comprises about 1 to about 40 parts of the polar solvent to about 1 part of milled fiber material. In some embodiments, the milled fiber material has a weighted-average fiber length of about 0.03 mm to about 0.12 mm. In some embodiments, a discontinuous fiber-reinforced MMC is manufactured by the method described above. The milled fiber material can include a ceramic and can include alumina silicate. The polar solvent can include a polar organic solvent. The metal can include aluminum or an aluminum alloy. The method can include substantially uniformly distributing the milled fiber in the discontinuous fiber preform.

Yet another aspect of the technology includes a fiber-reinforced MMC. The fiber-reinforced MMC includes a milled fiber material having a weighted-average fiber length of about 0.03 mm to about 0.12 mm, wherein the milled fiber material is at least substantially free of a binder material. The fiber-reinforced MMC further includes a metal infiltrated into the milled fiber material. The milled fiber can be substantially uniformly oriented in the fiber-reinforced MMC.

In some embodiments, the metal is an A201 aluminum alloy in a 26% volume fraction of alumina-silicate fibers. In some embodiments, the weighted-average fiber aspect ratio is correlated to a percent fiber volume fraction of the fiber preform. The milled fiber material can include a ceramic and can include alumina silicate. The polar solvent can include a polar organic solvent. The metal can include aluminum or an aluminum alloy.

Yet another aspect of the technology includes a fiber-reinforced MMC. The fiber-reinforced MMC includes a milled fiber material having a percent fiber volume fraction of the fiber preform of about 15% to about 55%, wherein the milled fiber material is at least substantially free of a binder material. The fiber-reinforced MMC further includes a metal infiltrated into the milled fiber material. The milled fiber can be substantially uniformly oriented in the fiber-reinforced MMC.

In some embodiments, a weighted-average fiber aspect ratio is correlated to the percent fiber volume fraction of the fiber preform. In some embodiments, the metal is an A201 aluminum alloy in about a 26% volume fraction of alumina-silicate fibers. The milled fiber material can include a ceramic and can include alumina silicate. The polar solvent can include a polar organic solvent. The metal can include aluminum or an aluminum alloy.

BRIEF DESCRIPTION OF THE DRAWINGS

The present drawings are provided for the purpose of describing specific embodiments and concepts relating to the present invention, and are not provided by way of definition or limitation thereof. Accordingly, the present systems and methods can be better illustrated and understood in view of the accompanying drawings, in which.

DETAILED DESCRIPTION

Figure 1:
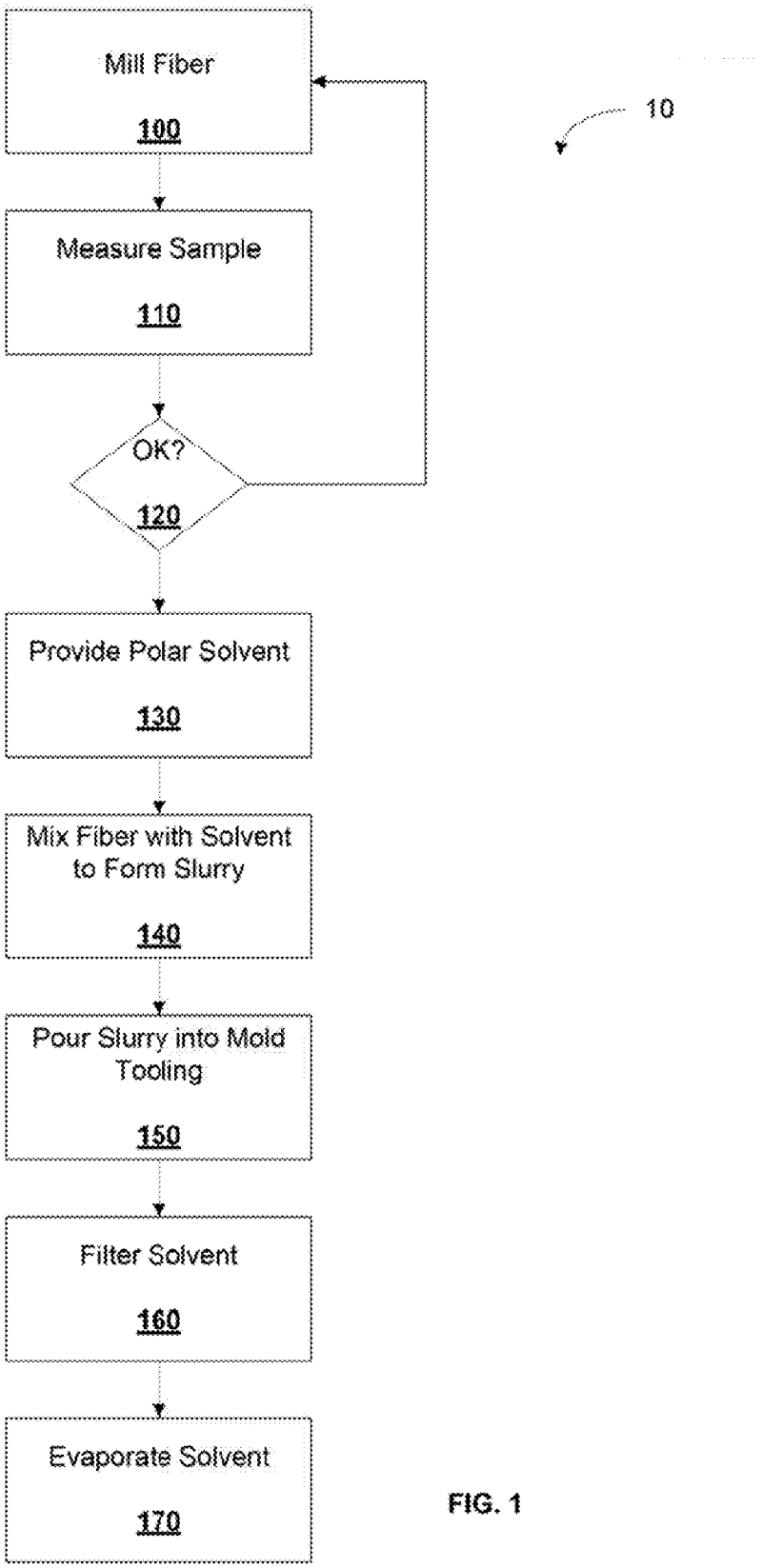
FIG. 1 is a flowchart depicting an exemplary method of manufacturing a preform according to embodiments of the invention.

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "pin assembly" is a reference to one or more pin assemblies and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. All sizes recited herein are by way of example only, and the invention is not limited to structures having the specific sizes or dimensions recited below. Nothing herein is to be construed as an admission that the embodiments described herein are not entitled to antedate such disclosure by virtue of prior invention. As used herein, the term "comprising" means "including, but not limited to." As used herein, the term "about," when referring to a value, means plus or minus 10% of the value.

Metal Matrix Composites (MMCs), fiber preforms therefor, and methods for making same are disclosed herein. In particular, fiber-reinforced aluminum (FRA), including FRA billets, and methods for making FRA and preforms employing FRA are disclosed. In particular, the methods and materials do not require the use of binder material, and therefore have improved characteristics. The MMCs and particularly the FRAs of certain embodiments of the invention are substantially free of binder material. The binder material can be colloidal silica or an organic binder such as a wax (e.g., paraffin wax). By "substantially free" of binder material, it is meant that any binder material is present in less than about 1% by weight of the non-solvent components. In some embodiments, this means less than about 0.5% binder material by weight of the non-solvent components. In some embodiments, this means less than about 0.1% binder material by weight of the non-solvent components. In some embodiments, this means less than about 0.01% binder material by weight of the non-solvent components.

The discontinuous fiber preforms manufactured according to the methods described herein are manufactured from milled fibers and can have a range of fiber lengths. It will be recognized that the fiber length will vary individually from fiber to fiber resulting from the milling process. As used herein, fiber length refers to the weighted-average fiber length of a group or sample of fibers. For example, a fiber length of about 0.12 mm means that the fibers employed have a weighted average fiber length of about 0.12 mm.

Individual fiber lengths within the group can vary above and below the weighted average fiber length. In some embodiments, each individual fiber will have a fiber length within +/− about 10%, +/− about 25%, or +/− about 30% of the median fiber length. As discussed herein, the desired weighted average fiber length or weighted average fiber aspect ratio (i.e., length:diameter) affects the fraction percent of fiber volume in the preform. Once desired volume percent of fiber in the preform is determined, the appropriate weighted-average fiber length or weighted-average fiber aspect ratio can be chosen. Conversely, if the weighted-average fiber length or weighted-average fiber aspect ratio is known, the correlating volume percent can be determined for a particular application. Knowing either or both will help one of skill in the art determine the appropriate fibers to use in a particular application.

In some embodiments, the weighted-average fiber length is between about 0.03 and about 0.12 mm. In some embodiments, the weighted-average fiber length is between about 0.08 and about 0.10 mm. In some embodiments, the weighted-average fiber length is between about 0.06 and about 0.08 mm. For example, a metal billet comprised of about a 26% volume fraction of fiber in the preform can have a weighted-average fiber length between about 0.04 and about 0.06 mm.

In some embodiments, the preform comprises between about 17.5% and about 50% by volume (i.e., fraction percent of fiber volume) of discontinuous fiber material. In some embodiments, the preform comprises between about 25% and about 40% by volume of discontinuous fiber material. In some embodiments, the preform comprises about 30% by volume of discontinuous fiber material.

Any suitable fiber material can be used, including monofilament and/or multifilament materials. Suitable materials can include, but are not limited to, alumina silicate (e.g., polycrystalline alumina silicate, high grade alumina silicate (e.g., about 85% alumina, about 90% alumina, about 95% alumina, about 99% alumina, or ranges between any two of these values) or other forms of alumina silicate), silicon carbide, basalt, boron, etc. In some embodiments, the fiber is an alumina silicate fiber manufactured by Saffil Ltd. of Cheshire, England, such as SAFFIL® Catalytic Grade (CG) grade fiber, SAFFIL® RF grade fiber, or SAFFIL® HA grade fiber, or combinations thereof.

The discontinuous fiber reinforced MMC manufactured according to the methods described herein can include various metals, including about 95% aluminum, about 99% aluminum, about 99.9% aluminum, or ranges between any two of these values, or a wrought or casting aluminum alloy, including A201, A356, A357, A535, A1100, A2024, A2219, A6061, C355 or any other aluminum alloy, or combinations of aluminum alloys. Other metals such as magnesium, titanium, copper, zinc, lead, and mixtures thereof can be used. The discontinuous fiber reinforced metal billet can be any suitable fiber material (e.g., monofilament and/or multifilament fibers) such as alumina silicate (as described above), or other forms of alumina silicate), silicon carbide, basalt, boron, etc. and any of the metals or combinations thereof described above. For example, the discontinuous fiber reinforced metal billet can include alumina-silica fiber and the A201 aluminum alloy.

The discontinuous fiber-reinforced MMC billets are manufactured from milled fibers and can have a range of fiber lengths. It will be recognized that the fiber length will vary individually from fiber to fiber during the milling process. As used herein, fiber length refers to the weighted-average fiber length of a group or sample of fibers. For example, a fiber length of about 0.12 mm means that the fibers employed have a weighted-average fiber length of about 0.12 mm.

Individual fiber lengths within the group can vary above and below the weighted average fiber length. In some embodiments, each individual fiber will have a fiber length within +/− about 10%, +/− about 25%, or +/− about 30% of the weighted-average fiber length. As discussed herein, the desired weighted-average fiber length or weighted-average fiber aspect ratio affects the fraction percent of fiber volume in the preform. Once a desired volume percent of fiber in the preform is determined, the appropriate weighted-average fiber length or weighted-average fiber aspect ratio can be chosen. Conversely, if the weighted-average fiber length or weighted-average fiber aspect ratio is known, the correlating volume percent can be determined for a particular application. Knowing either or both will help one of skill in the art determine the appropriate fibers to use in a particular application.

In some embodiments, the weighted-average fiber length is between about 0.03 and about 0.12 mm. In some embodiments, the weighted average fiber length is between about 0.08 and about 0.10 mm. In some embodiments, the weighted average fiber length is between about 0.06 and about 0.08 mm. For example, a metal billet comprised of about a 26% volume fraction of fiber can have a weighted-average fiber length between about 0.04 mm and about 0.06 mm.

In some embodiments, the fiber-reinforced metal MMC is manufactured from a preform that comprises between about 17.5% and about 50% by volume (i.e., the fraction percent of fiber volume in the MMC) of discontinuous fiber material. In some embodiments, the preform comprises between about 25% and about 40% by volume of discontinuous fiber material. In some embodiments, the preform comprises about 30% by volume of discontinuous fiber material.

Any suitable fiber material can be used. Monofilament and/or multifilament materials can be used. Suitable materials include, but are not limited to, alumina silicate (e.g., polycrystalline, high grade, or other forms), silicon carbide, basalt, boron, etc. In some embodiments, the fiber is an alumina silicate fiber manufactured by Saffil Ltd. of Cheshire, England, such as SAFFIL® Catalytic Grade (CG) grade fiber, SAFFIL® RF grade fiber, or SAFFIL® HA grade fiber, or combinations thereof.

An exemplary method of manufacturing a preform according to some embodiments is illustrated in FIG. 1. The method 10 includes milling the fiber (step 100), measuring a sample of the milled fiber (step 110), verifying the weighted-average fiber length of the sample of milled fiber (step 120), providing a polar solvent (step 130), mixing the milled fiber and the polar solvent to form a slurry (step 140), pouring the slurry into a mold tooling (step 150), filtering the solvent from the slurry (step 160) and evaporating the remaining solvent from the fibers (i.e., the retentate) (step 170).

In the milling step (step 100), bulk fiber (e.g., alumina-silicate fiber) is milled to desired lengths (e.g., a desired length distribution and/or aspect ratio) that correlate with a target volume fraction of fiber in the preform. Fiber mill processing is known in the art and can include processes such as jet milling, hammer milling, or knife milling. In some embodiments, the fiber can be available in a continuous tow (e.g., in a long fiber strand), and the milling step (step 100) can include fiber mill processing (as described above), cutting with a ceramic knife, or precision cutting (e.g., with an automated shear process). In some embodiments, the fiber can be pre-cut (e.g., provided by a manufacturer with a certain length distribution and/or aspect ratio) and the milling step is not required. In the measuring step (step 110), a sample (e.g., about 1 gram) of milled fiber is measured to determine the distribution of fiber lengths in the sample. A 1 gram sample can include over about 1,000, over about 5,000, over about 7,500, or over about 10,000 individual fiber strands. Fiber length can be measured with a stereoscope or other known instrument such as a filar microscope, an electro-optic imaging system equipped with image and analysis software, or a projection magnifier.

Figure 2:
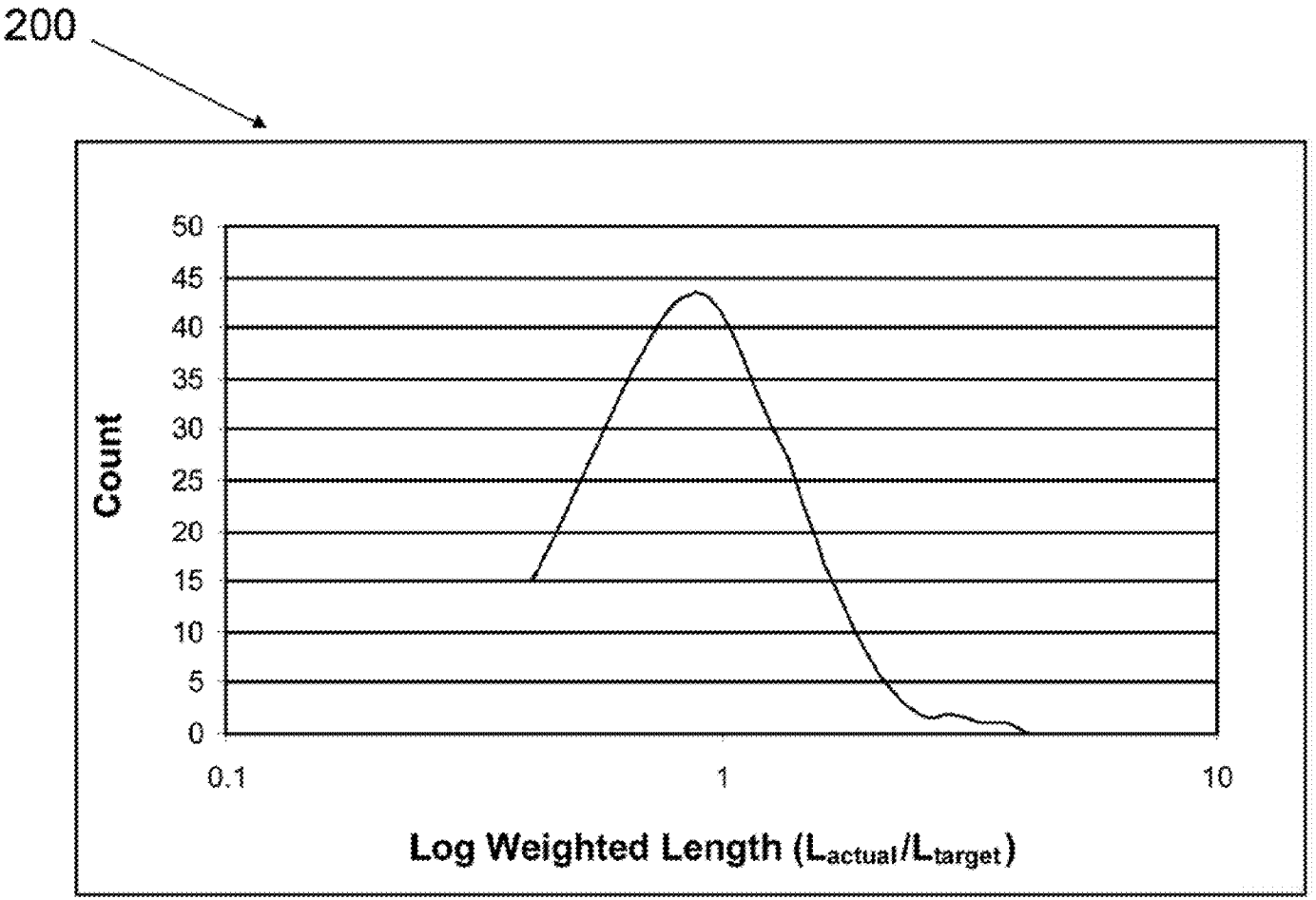
FIG. 2 is a graph of an exemplary normalized fiber length distribution after the milling process.

An exemplary graph of a normalized fiber length distribution after the milling process is illustrated in FIG. 2. The graph 200 depicts a typical normalized distribution (i.e., the actual fiber length divided by the target fiber length) of a 100-fiber sample. A fiber length distribution that at least approximately conforms to the graph depicted in FIG. 2 can produce FRA materials that are substantially uniform in volume fraction and/or distribution (e.g., orientation) of fiber reinforcement material and can have substantially homogeneous and/or isotropic mechanical properties.

Figure 3:
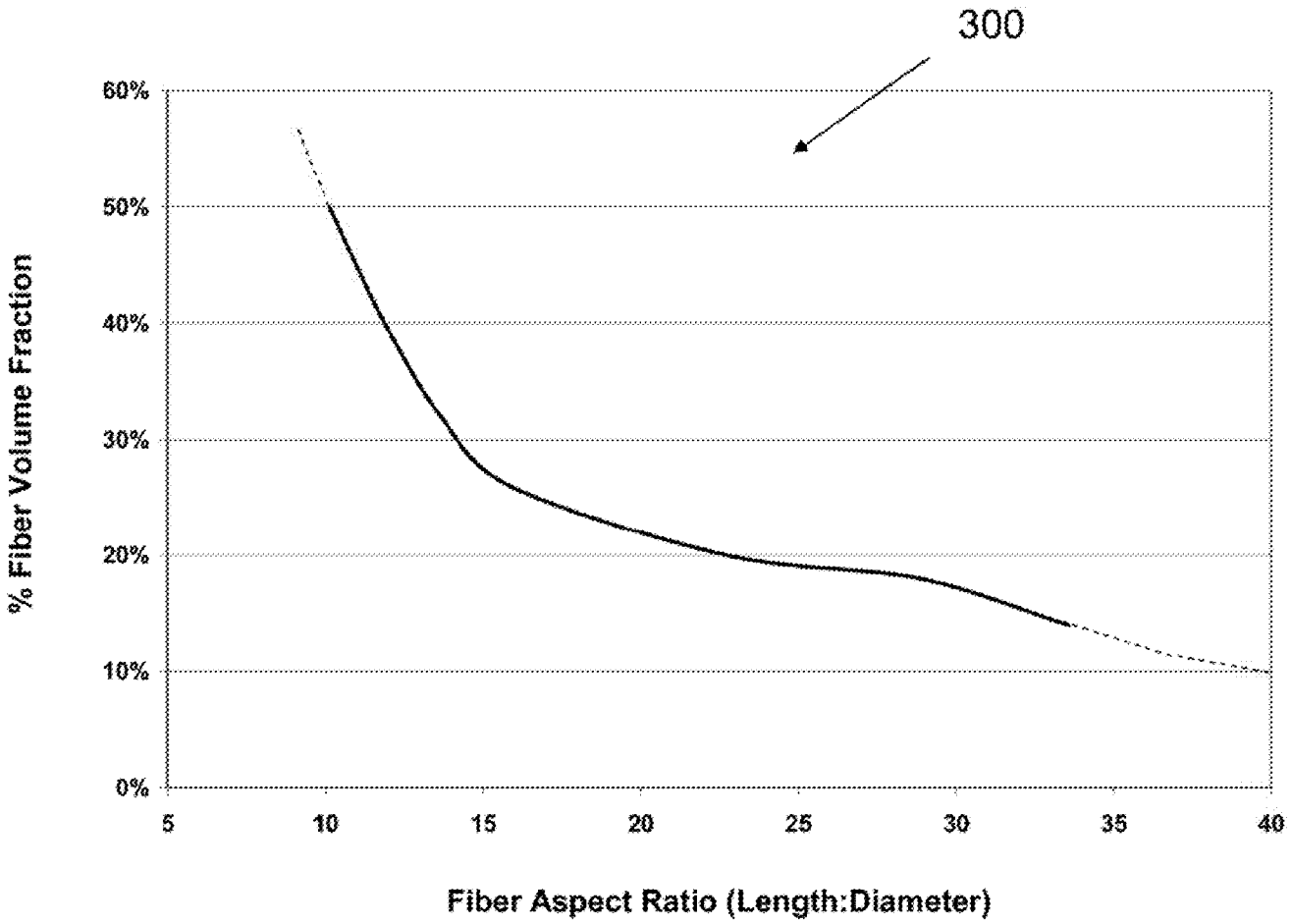
FIG. 3 is a graph showing a typical relationship between the aspect ratio and volume fraction of fiber in the preform.

A typical relationship between the weighted-average fiber aspect ratio (i.e., length:diameter) and volume fraction of fiber in the preform is illustrated in FIG. 3. The volume fraction, as discussed below, is correlated to the mechanical properties (e.g., ultimate tensile strength and/or Young's modulus) of the resulting FRA material. As depicted in the graph 300, a relatively large fiber aspect ratio (e.g., about 25) results in a relatively low fiber volume fraction (e.g., about 18%). In contrast, a relatively small fiber aspect ratio (e.g., about 12) results in a relatively high fiber volume fraction (e.g., about 50%). As discussed below, the fiber volume fraction is correlated with the mechanical properties of the FRA material. Different applications for discontinuous FRA materials can have different mechanical property requirements, fiber volume fractions, corresponding fiber aspect ratios, and/or weighted-average lengths. In some embodiments, the variation in the weighted average fiber aspect ratio can be smaller (e.g., a variation of about +/− about 1 aspect ratio, +/− about 2 aspect ratios, or +/− about 3 aspect ratios, or ranges between any two of these values) when the weighted-average length of the fiber is shorter (e.g., less than about 0.06 mm). In some embodiments, the variation in the weighted average fiber aspect ratio can be greater (a variation of about +/−5 aspect ratios, about +/−7 aspect ratios, about +/−10 aspect ratios, or ranges between any two of these values) when the weighted-average length of the fiber is longer (e.g., greater than about 0.06 mm). The variation in the weighted average fiber aspect ratio can be smaller when the weighted-average length of the fiber is shorter because additional fiber milling (step 100) may be employed to manufacture shorter weighted-average fiber lengths. The additional fiber milling (step 100) can reduce the number of longer fibers (i.e., fibers that do not conform to the target weighted-average fiber length). In contrast, less fiber milling (step 100) may be employed to manufacture longer weighted-average fiber lengths, which can increase the variation in the weighted average fiber aspect ratio. The reduction in fiber milling (step 100) can increase the number of longer and shorter fibers (i.e., fibers that do not conform to the target weighted-average fiber length), which can increase the variation in the weighted average fiber aspect ratio.

Returning to FIG. 1, the verifying step (step 120) includes determining whether the weighted-average fiber length of the sample is approximately equal to the desired volume fraction of fiber in the preform (e.g., according to the relationship depicted in FIG. 3). If the weighted-average fiber length is too long, the milled fiber is returned to the milling step (step 100) for additional milling. If the weighted-average fiber length is too short, the milled fiber is discarded and the process returns to the milling step (step 100) to start the process over with virgin bulk fiber. If the weighted-average fiber aspect ratio correlates with the desired volume fraction of fiber in the preform, the process continues to the providing step (step 130) where a polar solvent is provided. The polar solvent can be prepared fresh, can be purchased, or can be a previously prepared stock solvent. The polar solvent can include water (e.g., distilled water), an organic polar solvent (e.g., an organic polar solvent, an organic polar solvent solution, an organic polar solvent mixture, an organic polar solvent suspension, etc.) or a mixture of water and organic polar solvent. Suitable polar organic solvents can include alcohols (e.g., methanol, isopropanol, ethanol, etc.), ketones (e.g., acetone), other polar organic solvents, or combinations thereof. The polar solvent can be manufactured by mixing between about 0 to about 100 parts water (e.g., distilled water) by volume with between about 100 to about 0 parts organic polar solvent by volume. In some embodiments, the polar solvent can include about 10 parts water, about 20 parts water, about 30 parts water, about 40 parts water, about 50 parts water, about 60 parts water, about 70 parts water, about 80 parts water, about 90 parts water, about 100 parts water, or ranges between any two of these values. In some embodiments, the organic polar solvent can include about 10 parts polar organic polar solvent, about 20 parts polar organic polar solvent, about 30 organic polar solvent, about 40 parts organic polar solvent, about 50 parts organic polar solvent, about 60 parts organic polar solvent, about 70 parts organic polar solvent, about 80 parts organic polar solvent, about 90 parts organic polar solvent, about 100 parts organic polar solvent, or ranges between any two of these values. In some embodiments, the polar solvent can include about 5% to about 10% distilled water (e.g., about 5 parts distilled water to about 10 parts distilled water) and about 90% to about 95% organic polar solvent (e.g., about 95 parts organic polar solvent to about 90 parts organic polar solvent, respectively). The ratio can be dependant on the drying behavior of the preform size and configuration (e.g., thicker preforms can take longer to dry). For example, a polar solvent that includes a higher percentage (e.g., about 80%, about 90%, about 95%, about 99%, or ranges between any two of these values) of a volatile polar solvent (e.g., isopropanol) can be used in a thicker preform to decrease drying time. In some embodiments, the polar solvent does not include water. In other embodiments, the polar solvent is water (i.e., there are no polar organic solvents).

In the mixing step (step 140), the polar solvent is mixed with the milled fiber in a mixing vessel (e.g., a cylinder or other geometry of convenient size and shape) to form a slurry. The slurry is created by mixing between about 1 to about 40 parts polar solvent by volume to about 1 part milled fiber by mass. In some embodiments, the ratio is between about 1 to about 15 parts polar solvent to about 1 part milled fiber by mass. In some embodiments, the ratio is between about 1 to about 10 parts polar solvent to about 1 part milled fiber by mass. In some embodiments, the ratio is between about 1 to about 5 parts polar solvent to about 1 part milled fiber by mass. In some embodiments, the ratio is between about 10 to about 15 parts polar solvent to about 1 part milled fiber by mass. In some embodiments, the ratio is between about 15 to about 20 parts polar solvent to about 1 part milled fiber by mass. The ratio can be a balance between fluidity of slurry and volume of slurry. For example, longer fibers can require more polar solvent to assist with mixing and prevent fiber agglomeration. In a specific embodiment, a billet weighing about 40 pounds can be manufactured from a slurry comprised of about 6 kilograms of fiber and about 24 liters of polar solvent.

The slurry can be mixed either by hand or by a motorized mixing device for time sufficient to ensure that the slurry is at least substantially consistent. In some embodiments, the mixing can occur for about 20 seconds to about 1 hour, or about 1 minute, about 5 minutes, about 10 minutes, about 20 minutes, about 30 minutes, about 40 minutes, about 50 minutes, or in ranges between any two of these times, including about 5 minutes to about 10 minutes. In some embodiments, the components of the polar solvent (e.g., water and/or polar organic solvent) and the milled fiber can be added to the mixing vessel without pre-mixing the individual components (e.g., distilled water and/or organic polar solvent can be combined with milled fiber in the mixer without first manufacturing the polar solvent as described in step 130).

In the pouring step (step 150), the slurry mixture is poured into a mold tooling. The mold tooling can be formed out of graphite, polytetrafluoroethylene, glass (e.g., silicon dioxide), high-density polyethylene ("HDPE"), other non-porous and non-reactive materials, or combinations thereof. The mold tooling can be cylindrical, spherical, parallelpiped, or any other shape that may be related to the ultimate shape of the FRA material application (e.g., automobile structural part, piston, bushing, etc.). In some embodiments, the slurry mixture is released into the mold tooling from a mixing vessel disposed above the mold tooling. In some embodiments, the shape of the mold tooling conforms to the shape of the mixing vessel.

In the filtering step (step 160), the slurry mixture is filtered with a porous medium (e.g., a filter, sieve, or screen) formed out of a material (e.g., polytetrafluoroethylene) that is not reactive with the slurry mixture. The porous medium retains the fibers while allowing the polar solvent to pass therethrough. As the polar solvent drains through the porous medium, the fibers in the slurry settle and conform to the shape of the mold tooling to form a preform with substantially uniformly oriented and random (e.g., randomly-oriented and/or isotropic) fibers. A vacuum pump can be used to enhance the speed of the draining process. The vacuum pump can apply a cyclic or steady state pressure differential of about 1", about 5", about 10", about 15", about 20", about 25", or about 30" of mercury, or ranges between any two of these values. The polar solvent can be reclaimed and/or recycled for future manufacturing.

Any remaining polar solvent can be evaporated from the preform in step 170. The evaporation can occur by heating the settled slurry to a temperature of about 20° C., about 30° C., about 40° C., about 50° C., about 60° C., about 70° C., about 80° C., about 90° C., about 100° C., or ranges between any two of these temperatures. The heating can occur for a period of about 1 hour, about 5 hours, about 10 hours, about 25 hours, about 50 hours, about 75 hours, about 100 hours, about 125 hours, about 150 hours, about 175 hours, about 200 hours, about 225 hours, about 250 hours, about 275 hours, about 300 hours, or ranges between any two of these times. The time and temperature needed for evaporation can vary depending on the preform volume and dimensions and the type of polar solvent used in the slurry. For example, an equilateral preform with substantially equivalent sides (e.g., a cube or a cylinder with a diameter and length that are about the same) and a volume of about 380 cubic inches can take about 48 hours at about 55° C. to evaporate about 90% of the organic polar solvent. An equilateral preform with substantially equivalent sides (e.g., a cube or a cylinder with a diameter and length that are about the same) and a volume of about 380 cubic inches fabricated with 100% distilled water (i.e., 0% organic polar solvent) can take about 72 hours at about 55° C. to evaporate about 90% of the distilled water. The preform can be weighed periodically to determine when the evaporation is at least substantially complete (i.e., when the weight of the preform is substantially stable over a period of time, e.g., about a half hour).

Figure 4:
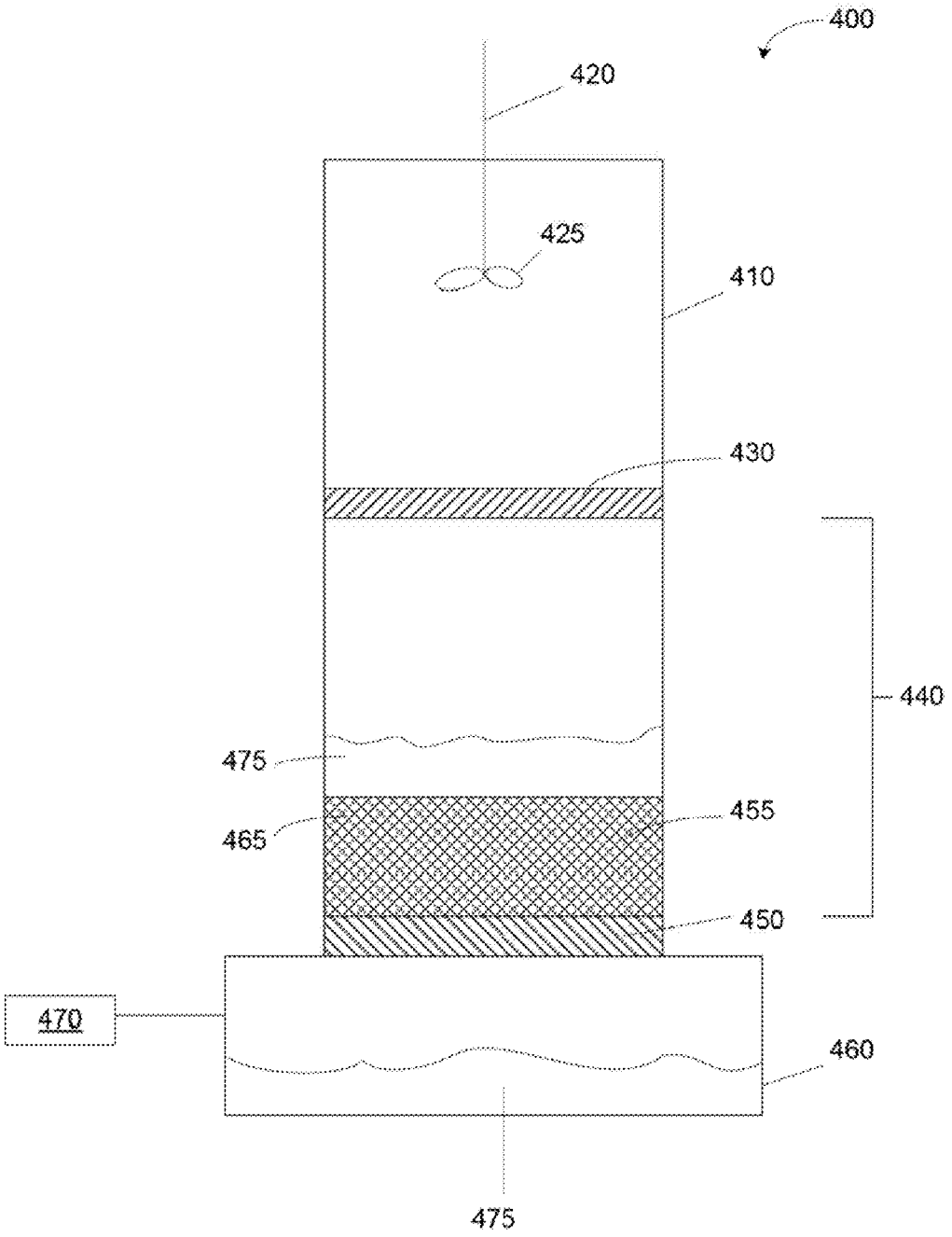
FIG. 4 is a cross-sectional schematic view of an exemplary apparatus for manufacturing a preform according to embodiments of the invention.

An exemplary apparatus for manufacturing a preform according to some embodiments of the invention is illustrated in FIG. 4. The apparatus 400 includes a mixing vessel 410, an optional motorized stirrer 420, a release mechanism 430, a mold tooling 440, a porous structure 450, and a reservoir 460. In some embodiments, the apparatus 400 can be used to implement the method 10 described above.

The mixing vessel 410 is adapted to retain a liquid (e.g., a polar solvent and/or a slurry, as described above) and can be formed out of glass, polyethylene, polytetrafluoroethylene, polyvinylidene fluoride, or other non-porous and non-reactive material, or combinations thereof. The optional motorized stirrer 420 is disposed in the mixing vessel 410 and includes fins and/or blades 425 that are adapted to agitate the liquid.

The release mechanism 430 is disposed between the mixing vessel 410 and the mold tooling 440. In a first position (e.g., as depicted in FIG. 4), the release mechanism 430 forms a mechanical seal with the mixing vessel 410, allowing the mixing vessel 410 to retain the liquid. In a second position (not shown), the release mechanism 430 slides or rotates laterally (e.g., radially or across a minor axis of the apparatus 400) to break the seal, thereby allowing the slurry to flow from the mixing vessel 410 to the mold tooling 440. The release mechanism 430 can be made out of glass (e.g., silicon dioxide), polyvinyl chloride, rubber, polyethylene, polytetrafluoroethylene, polyvinylidene fluoride, combinations thereof, or other suitable non-reactive materials that can retain the slurry and withstand the weight/pressure of the slurry in the mixing vessel 410.

The mold tooling 440 is positioned (e.g., concentrically disposed) beneath the release mechanism 430 and the mixing vessel 410. The mold tooling 440 can have substantially the same shape (e.g., substantially the same diameter) as the mixing vessel 410. However, in some embodiments, the mold tooling 440 has a different shape than the mixing vessel 410. The mold tooling 440 can be formed out of graphite, polytetrafluoroethylene, acrylic, glass (e.g., silicon dioxide), HDPE or other non-porous and non-reactive materials. In some embodiments, the slurry contents of the mixing vessel 410 are poured into the mold tooling 440 (e.g., the mold tooling 440 is disposed adjacent to the mixing vessel 410) and, accordingly, the release mechanism 430 is not needed.

A porous structure 450 is disposed between the mold tooling 440 and the reservoir 460. The porous structure 450 can be a screen, a filter, a sieve, or other porous structure. The porous structure 450 is adapted to retain mesh fibers 455 in a slurry 465 and allow the polar solvent (e.g., organic polar solvent and/or distilled water) 475 in the slurry 465 to escape through the porous structure 450 (e.g., a screen) into the reservoir 460. A vacuum pump 470 can be in fluid communication with the reservoir 460 to reduce pressure in the reservoir 460 to enhance the speed of the filtering process. The mesh fibers 455 retained by the porous structure form a preform of substantially uniformly distributed and oriented (e.g., randomly oriented, isotropic) fibers. The preform can have substantially the same shape as an inside surface of the mold tooling 440. In some embodiments, the polar solvent 475 can be reclaimed and/or recycled for future manufacturing.

Figure 4A:
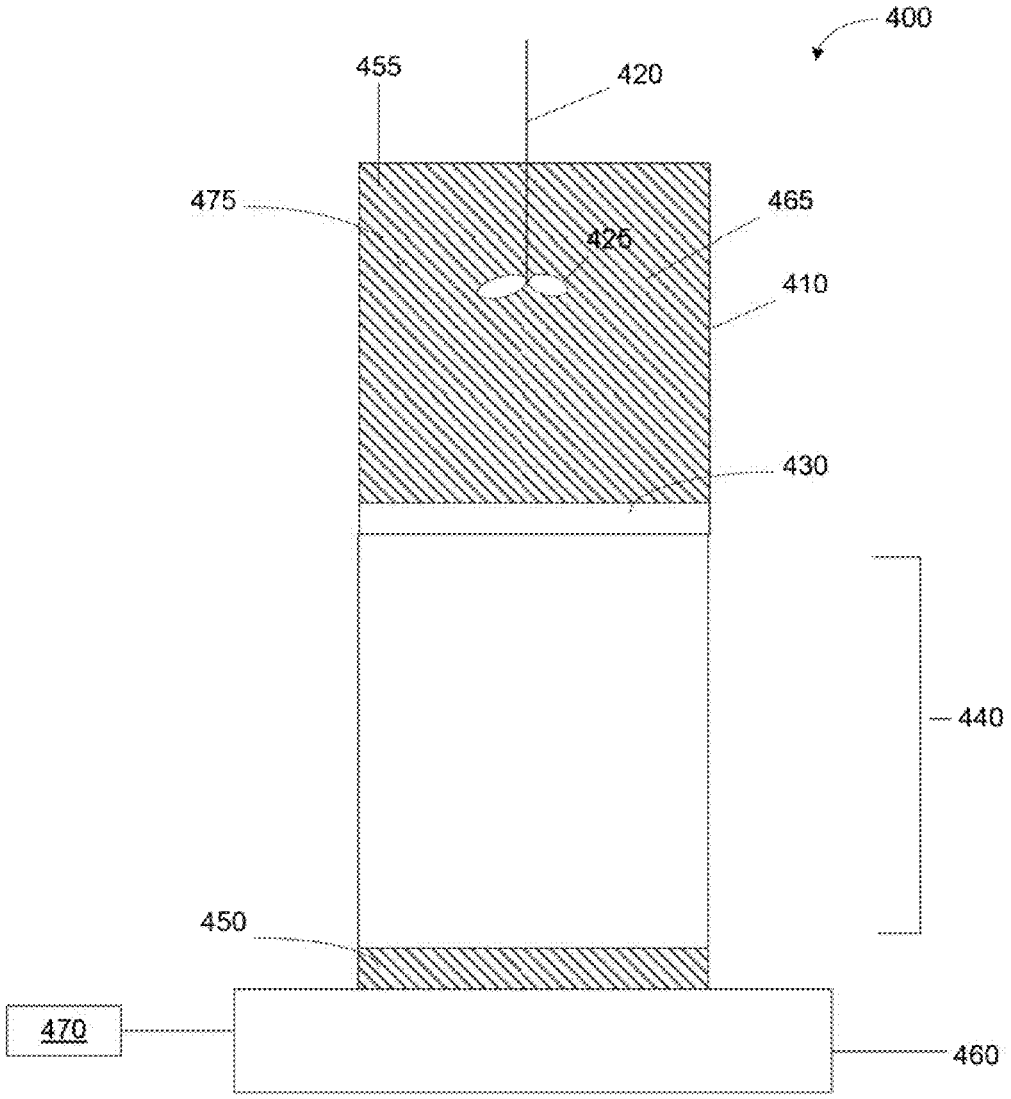
Figure 4B:
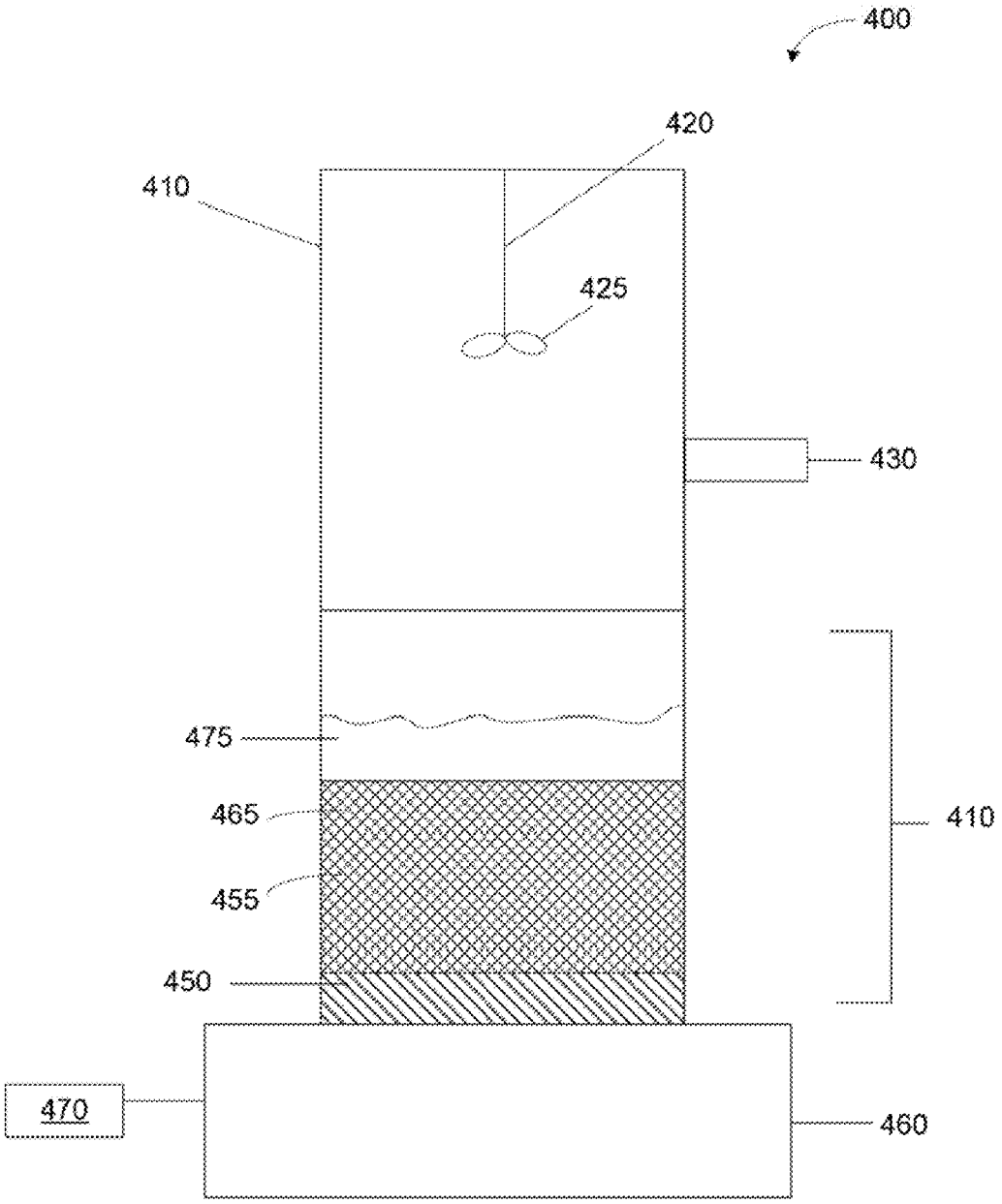
Figure 4C:
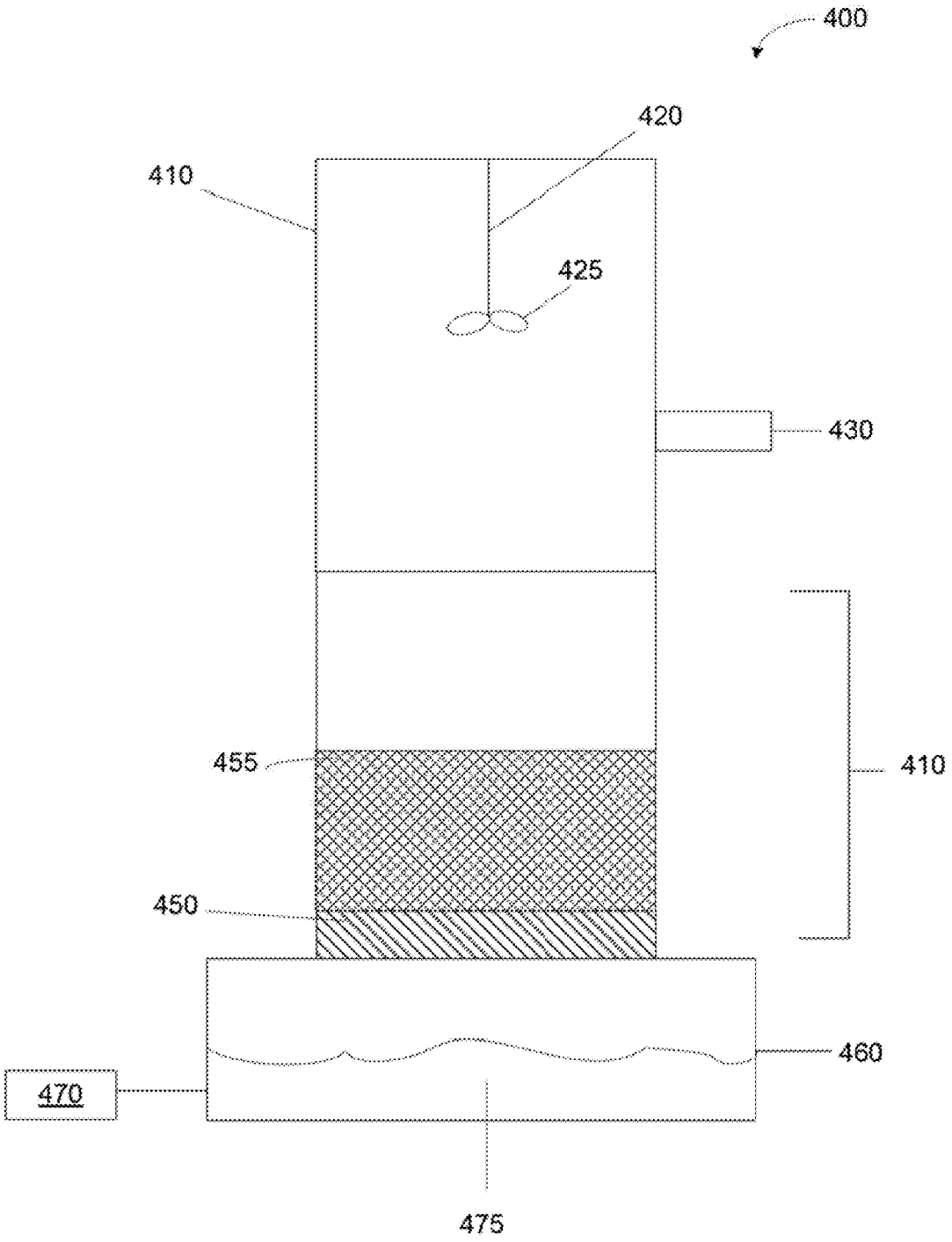

Operation of the apparatus 400 is illustrated in the exemplary cross-sectional schematic drawings in FIGS. 4A-4C. In FIG. 4A, the slurry 465 is formed in the mixing vessel 410 using the optional motorized stirrer 420. The slurry 465 includes a polar solvent 475 and mesh fibers 455. The polar solvent 475 can include more than one liquid (e.g., water and an organic polar solvent) which can be pre-mixed or can be mixed in the mixing vessel 410. The polar solvent 475 and mesh fibers 455 can be mixed for the time period described above (e.g., about 20 seconds to about 1 hour, or about 1 minute, about 5 minutes, about 10 minutes, about 20 minutes, about 30 minutes, about 40 minutes, about 50 minutes, or in ranges between any two of these times, including about 5 minutes to about 10 minutes) to form the slurry 465. The polar solvent 475, mesh fibers 455, and the slurry 465 are retained in the mixing vessel 410 by the release mechanism 430.

Once the slurry 465 is formed, the release mechanism 430 can be moved to a second position to release the slurry 465 from the mixing vessel 410 into the mold tooling 440, as illustrated in FIG. 4B. As the slurry 465 settles, the mesh fibers 455 accumulate in a bottom region 480 of the mold tooling 440 while the polar solvent 475 remains in an upper region 490 of the mold tooling 440.

The slurry 465 is then filtered through the porous structure 450, as illustrated in FIG. 4C. The porous structure 450 retains the mesh fibers 455 in the mold tooling 440 while allowing the polar solvent 475 to pass into the reservoir 460. The vacuum pump 470 can reduce the pressure in the reservoir 460 to decrease the time needed to filter the slurry 465. The mesh fibers 455 retained in the mold tooling 440 form a preform with substantially uniformly oriented and random (e.g., randomly-oriented and/or isotropic) fibers. The preform can then be dried according to the methods described above.

Figure 5:
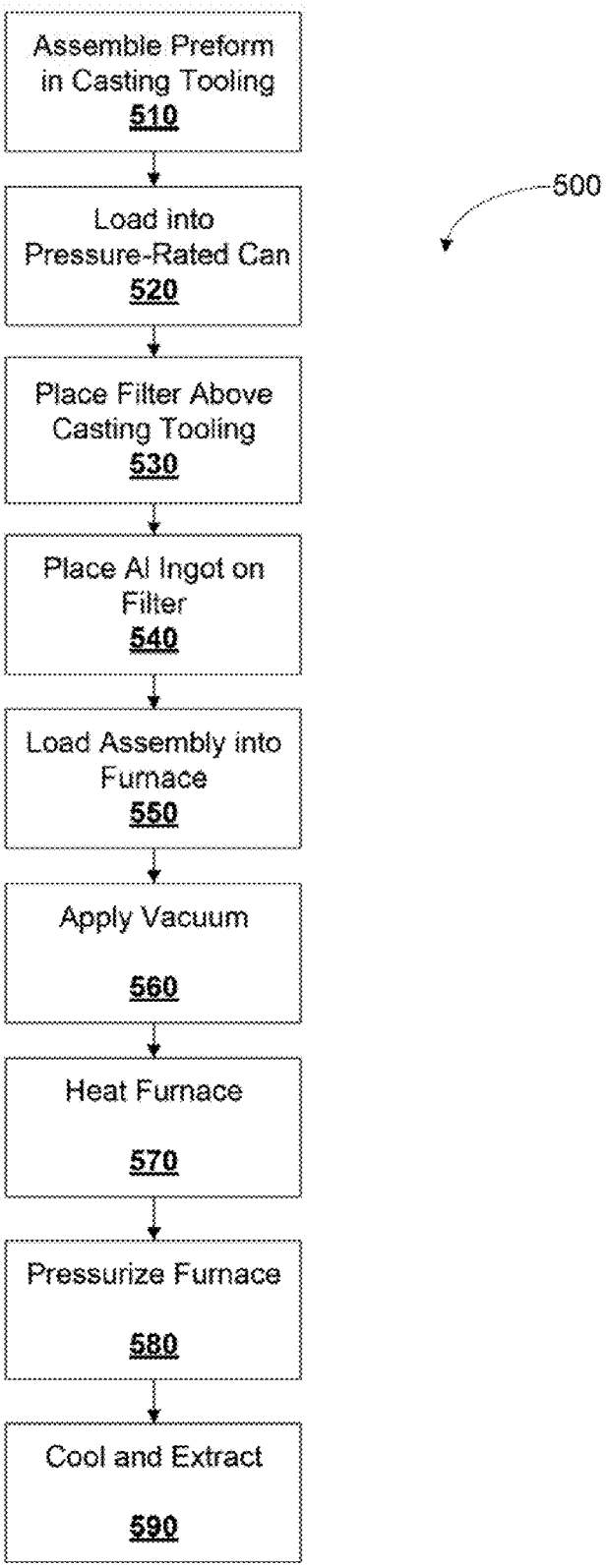
FIG. 5 is a flowchart depicting an exemplary method of manufacturing a discontinuous fiber-reinforced metal matrix composite according to embodiments of the invention.

An exemplary method of manufacturing a discontinuous fiber-reinforced MMC (e.g., fiber-reinforced aluminum) according to embodiments of the invention is illustrated in FIG. 5. The method 500 includes assembling a preform in a casting tooling (step 510), loading the preform in the casting tooling into a pressure-rated can (step 520), placing a filter above the casting tooling (step 530), placing a metal (e.g., an aluminum ingot or ingots) on the filter to form an assembly (step 540), loading the assembly into a furnace (step 550), applying a vacuum to the furnace (step 560), heating the furnace (step 570), pressurizing the furnace (step 580), and cooling the furnace to extract the manufactured fiber-reinforced MMC (step 590).

Figure 6:
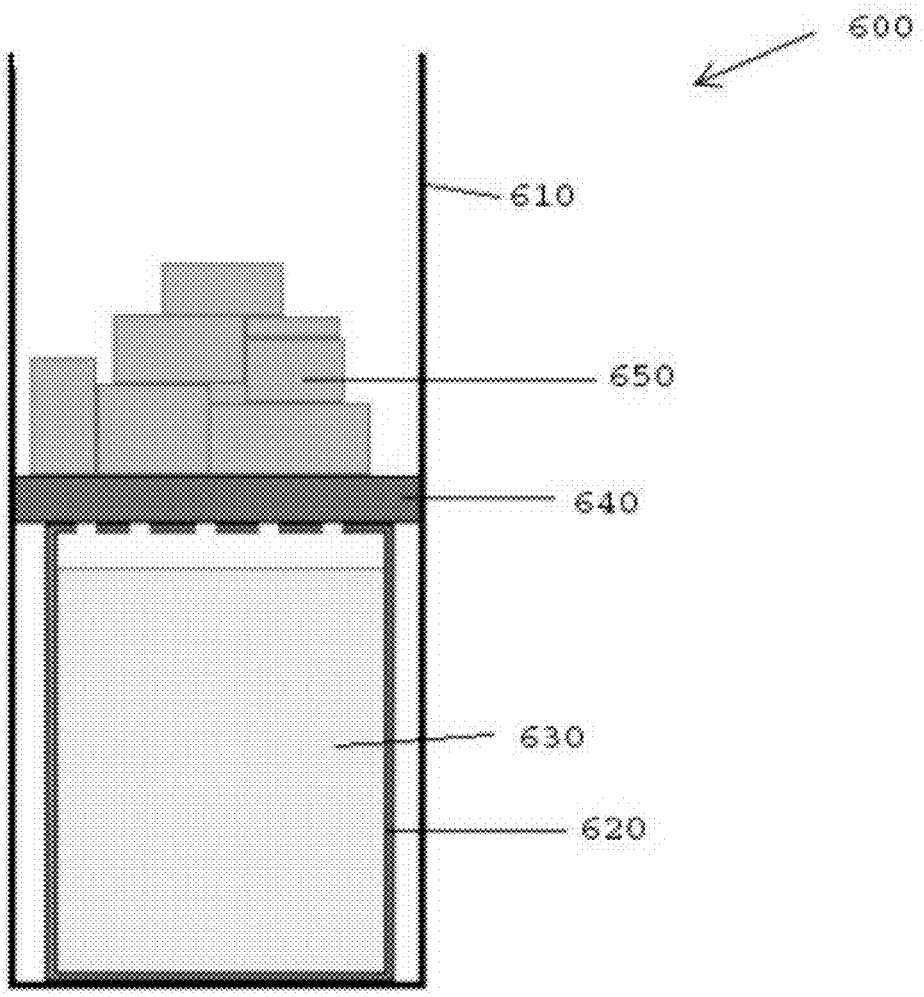
FIG. 6 is a perspective view of an example of a casting tooling according to some embodiments.
Figure 7:
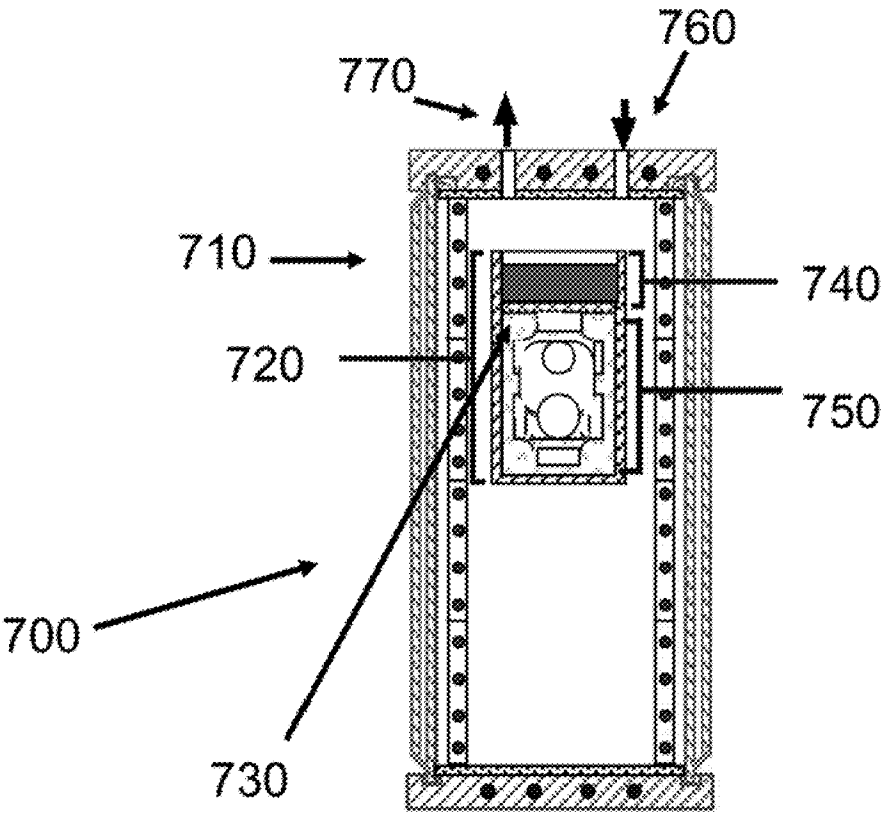
FIG. 7 is a cross-sectional view of an exemplary pressure infiltration system according to embodiments of the invention.

In the assembling step (step 510), a preform (e.g., a preform manufactured according to the method of FIG. 1) is disposed in a casting tooling (e.g., as depicted in FIGS. 6 and 7). The casting tooling includes a thermally-resistant material (e.g., graphite or other non-porous and non-reactive materials) that can be in the shape of a sleeve or other geometry. The loading step (step 520) includes loading the casting tooling with the preform into a pressure- and thermal-resistant can (e.g., a pressure-rated stainless steel can). In the placing a filter step (step 530), a filter or other porous structure or medium is disposed above the casting tool. In the placing a metal step (step 540), a metal or metal alloy (e.g., an aluminum or aluminum-alloy ingot or ingots) is placed on the filter. In some embodiments, the metal is 99.9% aluminum. In some embodiments, the metal alloy is a wrought or cast aluminum alloy, including A201 A201, A356, A357, A535, A1100, A2024, A2219, A6061, C355, or any other aluminum alloy, depending on the desired properties of the finished FRA component, or combinations of two or more of these materials.

An example of an apparatus that can implement the method above is illustrated in a schematic cross-sectional view in FIG. 6. The apparatus 600 includes a steel can 610, a casting tooling 620, a preform 630, a filter 640, and metal ingots 650. As discussed above, the preform 630 is disposed in the casting tooling 620 that includes a thermally-resistant material. The casting tooling 620 and the preform 630 are loaded into the steel can 610. The filter 640 is disposed (e.g., placed) in the steel can 610 above the casting tooling 620. Metal ingots 650 (e.g., an aluminum or aluminum alloy) are disposed on the filter 640. The metal ingots 650 can be placed on the filter 640 before or after the filter 640 is disposed in the steel can 610.

Returning to the flow chart in FIG. 5, in the loading step (step 550), the can assembly, including the filter and metal (e.g., aluminum ingot(s)), is loaded into a pressure- and thermal-resistant furnace (e.g., a pressure infiltration system as described below). In the applying step (step 560), a vacuum is applied to the furnace. The vacuum can be at a pressure from about 1 micron Hg to about 380,000 microns Hg, from about 10,000 microns Hg to about 250,000 microns Hg, or from about 75,000 microns Hg to about 150,000 microns Hg, or ranges between any two of these values. In some embodiments, the vacuum can be at a pressure between about 400 microns Hg to about 2,000 microns Hg. In some embodiments, the vacuum pressure is about 15 microns Hg. The vacuum can reduce atmospheric contamination and can assist with infiltration of metal (e.g., by increasing the pressure differential within the preform). In the heating step (step 570), the furnace applies heat to the can assembly to raise the temperature above the melting point of the metal. For example, the furnace can be heated to a temperature of about 650° C., about 675° C., about 700° C., about 725° C., about 750° C., about 775° C., about 800° C., or ranges between any two of these temperatures. The metal (e.g., aluminum ingot) and the preform can be heated to the same or different temperatures.

Once the metal (e.g., aluminum ingot) becomes molten (e.g., at a temperature between about 650° C. to about 720° C.), a pressure is applied to the furnace in step 580. In some embodiments, the pressure is about 50 psi, about 100 psi, about 250 psi, about 500 psi, about 800 psi, about 1,000 psi, about 1,200 psi, about 1,250 psi, about 1,500 psi or ranges between any two of these pressures. The pressure can force the molten metal (e.g., aluminum) to pass through (e.g., pressure infiltrate) the filter, into the preform and onto the fibers of the preform. In the cooling step (step 590), the furnace is cooled and returned to ambient temperature allowing the molten metal to solidify to form a discontinuous fiber-reinforced MMC (e.g., a discontinuous fiber-reinforced aluminum billet). In some embodiments, the pressure is maintained in the furnace (e.g., the pressure applied during the heating step (step 580)) during the cooling step (step 590). In some embodiments, the furnace is returned to ambient pressure during the cooling step (step 590).

The discontinuous fiber-reinforced MMC (e.g., discontinuous FRA) manufactured according to the process described in FIG. 5 can provide a range of improved properties. For example, a discontinuous FRA manufactured according to the process described in FIG. 5 can have a Young's modulus up to about 80% greater than the base aluminum alloys (i.e., the aluminum alloy by itself). A rule of mixtures can be used to determine the Young's modulus of the discontinuous FRA. That is, the Young's modulus of the MMC can be the weighted average of the Young's modulus of the fibers multiplied by the percentage by volume of fiber and the Young's modulus of the aluminum (or aluminum alloy or other metal) multiplied by the percentage by volume of aluminum (or aluminum alloy or other metal). In addition, the discontinuous MMC can have a wear resistance substantially equivalent to steel (e.g., carburized steel) at about a third of the weight.

In addition, the discontinuous fiber-reinforced MMC (e.g., discontinuous FRA) can have an ultimate tensile strength up to about 60% greater than the base aluminum alloy. For example, a MMC that includes aluminum alloy A201 and about a 26% fiber volume loading (e.g., a fiber volume fraction of about 26% in the MMC) treated to T6 temper can have an ultimate tensile strength of about 76 ksi to about 82 ksi. In contrast, aluminum alloy A201 (on its own, without being incorporated into a MMC) treated to T6 temper can have an ultimate tensile strength of about 60 ksi to about 65 ksi. The ultimate tensile strength of the discontinuous fiber-reinforced MMC can be increased by at least about 1 ksi for every percent of fiber volume loading in the MMC (e.g., a fiber volume fraction of about 26% in the billet can provide at least about 26 ksi of additional ultimate tensile strength compared to the ultimate tensile strength of the base aluminum alloy). In general, the volume fraction of fiber in the preform results in an equivalent percentage increase in ultimate tensile strength of the fiber-reinforced MMC (e.g., discontinuous FRA) billet compared to the ultimate tensile strength of the metal (e.g., aluminum) material by itself. For example, a 26% fiber volume fraction in a FRA billet can result in an isotropic increase in ultimate tensile strength of about 26 ksi compared to the ultimate tensile strength of the aluminum material by itself.

Further, the discontinuous MMCs manufactured according to the process in FIG. 5 can have enhanced mechanical properties compared to (a) discontinuous aluminum MMCs (e.g., discontinuous FRAs) that include a binder material or (b) particle-based MMCs (e.g., MMCs that include silicon-carbide particles). For example, discontinuous aluminum MMCs manufactured according to the process in FIG. 5 can have an ultimate tensile strength of about 80 ksi while discontinuous FRAs that include a binder material and particle-based aluminum MMCs can have an ultimate tensile strength between about 30 ksi to about 50 ksi. In addition, discontinuous aluminum MMCs manufactured according to the process in FIG. 5 can have a ductility of about 2% to about 2.5% while discontinuous FRAs that include a binder material and/or particle-based aluminum MMCs can have a ductility of about 0.5% to about 1.0%.

Additionally, the discontinuous MMCs manufactured according to the process described in FIG. 5 can be more easily machined compared to MMCs manufactured according to known discontinuous FRA manufacturing methods (e.g., discontinuous FRA materials that include a binder or a particulate (e.g., silicon carbide)). For example, the discontinuous FRA billet manufactured according to the process described in FIG. 5 can have machining characteristics similar to aluminum alloys when using carbide machining tooling.

An exemplary pressure infiltration system according to some embodiments is illustrated in FIG. 7. The pressure infiltration system 700 includes a furnace 710, a can 720, a filter 730, a metal ingot 740, and a casting tooling with preform 750. The furnace 710 is pressure- and thermally-resistant and can be manufactured out of pressure-rated stainless steel (e.g., able to withstand the pressures as described below). The furnace 710 includes input and output ports 760 and 770, respectively. The input port 760 is in fluid communication with a pump (not shown) or pressure reservoir to pressurize the furnace 710 (e.g., to a pressure of up to about 50 psi, about 100 psi, about 250 psi, about 500 psi, about 800 psi, about 1,000 psi, about 1,250 psi, about 1,500 psi or ranges between any two of these pressures). The output port 770 is in fluid communication with a vacuum pump (not shown) to apply a vacuum to the furnace 710. The vacuum can be at a pressure from about 1 micron Hg to about 380,000 microns Hg, from about 10,000 microns Hg to about 250,000 microns Hg, or from about 75,000 microns Hg to about 150,000 microns Hg. In some embodiments, the vacuum pressure is about 400 microns Hg to about 2,000 microns Hg.

The can 720 is disposed in the furnace 710. The can 720 is pressure- and thermally-resistant and can be manufactured out of steel, stainless steel, a thermally-resistant nickel-based alloy or an INCONEL® 718 alloy, available from Special Metals Corporation of Huntington, W. Va., or any other high temperature and pressure-resistant material, or combination thereof. The casting tooling with preform 750 is disposed in the can 720. The filter 730 is disposed above the casting tooling with preform 750 and inside the can 720. The filter 730 can be a wire mesh, a sieve, or other porous structure made out of a non-reactive material (e.g., alumina). The metal ingot 740 is disposed on the filter 730. The metal ingot 740 can be 99.9% aluminum, an aluminum alloy A201, A356, A357, A535, A1100, A2024, A2219, A6061, C355, or any other aluminum alloy, or combination of aluminum alloys.

In operation, the furnace 710 is heated above the melting point of the aluminum ingot 740 (e.g., to 650° C., about 675° C., about 700° C., about 725° C., about 750° C., about 775° C., about 800° C., or ranges between any two of these temperatures). In some embodiments, the furnace 710 heats the metal ingot 740 and the casting tooling with preform 750 to a different or the same temperature. As the furnace 710 heats up, a vacuum is applied through the output port 770. The vacuum can be at a pressure from about 1 micron Hg to about 380,000 microns Hg, from about 10,000 microns Hg to about 250,000 microns Hg, or from about 75,000 microns Hg to about 150,000 microns Hg. In some embodiments, the vacuum can be at a pressure between about 400 microns Hg to about 2,000 microns Hg. In some embodiments, the vacuum pressure is about 15 microns Hg.

When the metal ingot 740 (e.g., aluminum ingot) becomes molten (e.g., at about 650-720° C.), a pressure is applied through the input port 760. In some embodiments, the pressure is about 1,200 psi. The pressure causes the molten aluminum ingot 740 to pass through (e.g., pressure infiltrate) the filter 730, into the casting tooling with preform 750, and onto the fibers in the preform. The furnace 710 is cooled to solidify the metal, thereby forming a discontinuous MMC (e.g., fiber-reinforced aluminum) billet.

Figure 8:
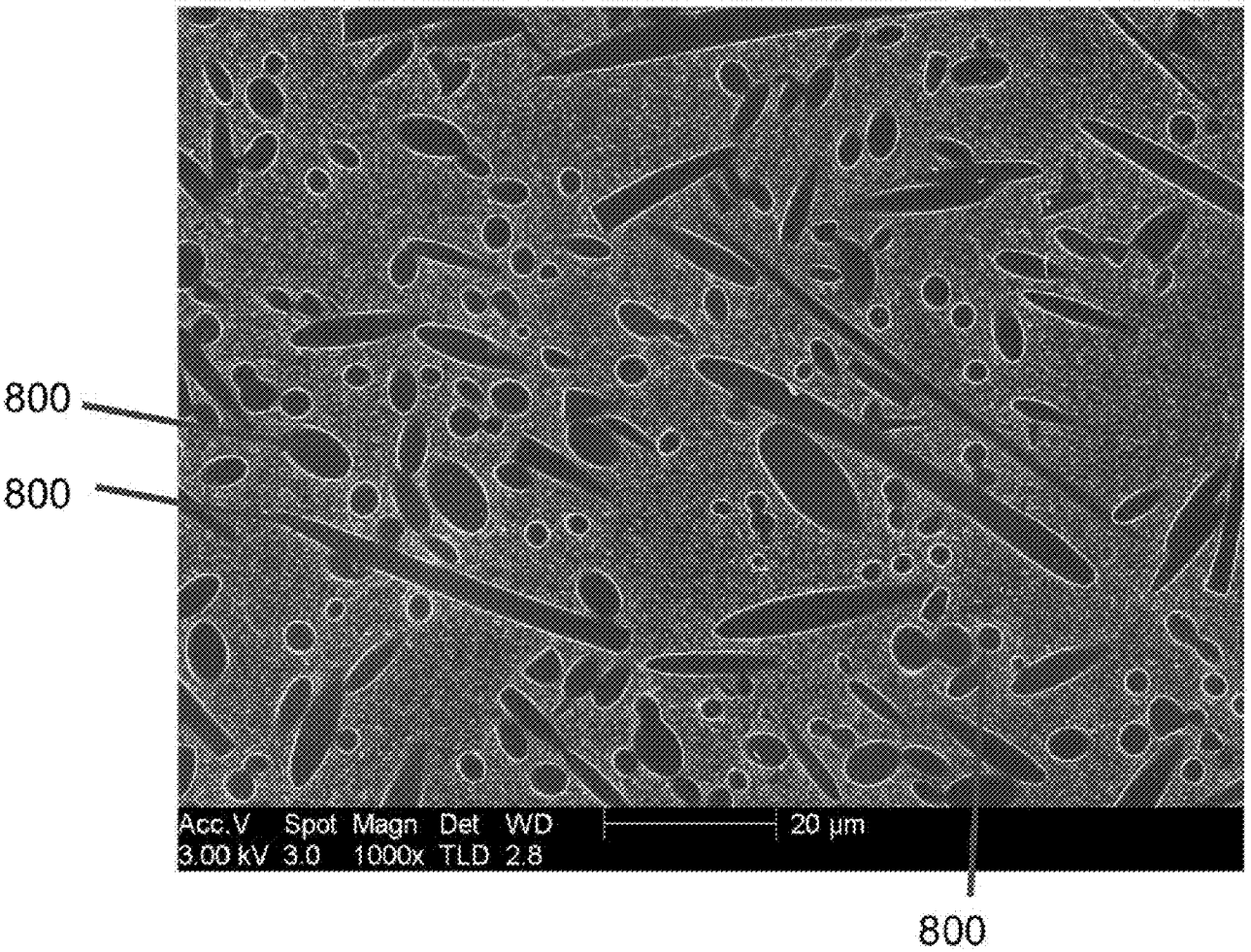
FIG. 8 is a scanning electron microscope image of an exemplary microstructure of discontinuous fiber-reinforced aluminum manufactured according to an embodiments of the invention.

A scanning electron microscope ("SEM") image of the microstructure of a discontinuous aluminum MMC (e.g., discontinuous FRA) billet manufactured according to the process described above is illustrated in FIG. 8. As illustrated in FIG. 8, the fibers 800 are substantially uniformly distributed and oriented (i.e., randomly oriented). The discontinuous aluminum MMC illustrated in FIG. 8 was manufactured with an A201 aluminum alloy in a 26% volume fraction of alumina-silicate fibers. This image was taken by an SEM at a magnification of 1000×. The same or similar relationship can occur with other aluminum or metal alloys and other fiber materials.

Figure 9:
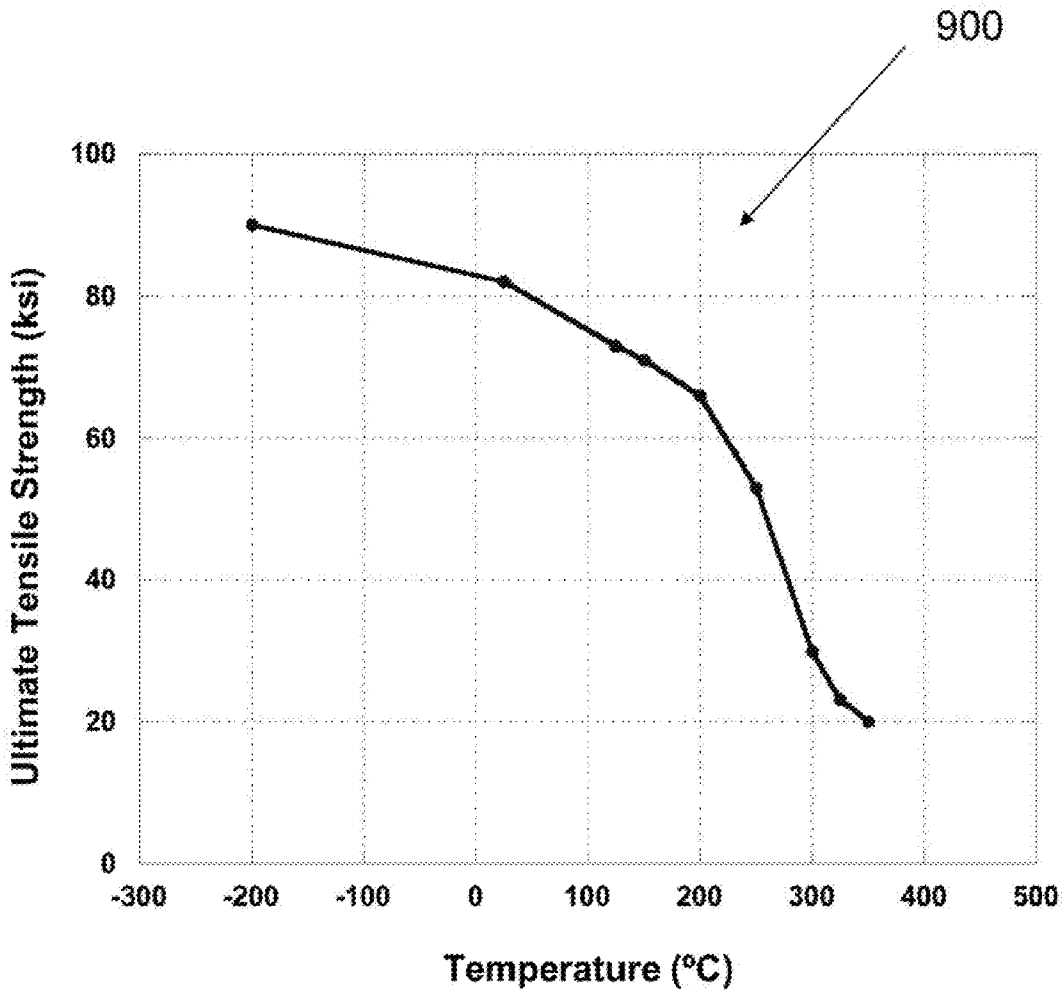
FIG. 9 is a exemplary graph showing the ultimate tensile strength of an exemplary fiber-reinforced aluminum as a function of temperature.

An exemplary graph 900 illustrating the relationship between the ultimate tensile strength of a discontinuous aluminum MMC (e.g., discontinuous FRA) billet as a function of temperature is depicted in FIG. 9. As in the sample used for the SEM image in FIG. 8, the discontinuous aluminum MMC billet used to generate the graph illustrated in FIG. 9 was manufactured with an A201 aluminum alloy in a 26% volume fraction of alumina-silicate fibers. At about 350° C., the discontinuous aluminum MMC billet has an ultimate tensile strength of about 20 ksi. At about −200° C., the discontinuous aluminum MMC billet has an ultimate tensile strength of about 90 ksi. The same or similar relationship can occur with other aluminum or metal alloys and other fiber materials.

The present disclosure is not intended to be limited by its preferred embodiments, and other embodiments are also comprehended and within its scope. Numerous other embodiments, modifications and extensions to the present disclosure are intended to be covered by the scope of the present inventions as claimed below. This includes implementation details and features that would be apparent to those skilled in the art in the mechanical, chemical or electronic implementation of the systems and methods described herein.

What is claimed is:

1. A fiber preform, comprising fibers having random and isotropic orientation, uniformly distributed in the fiber preform, the fibers having a weighted average fiber length of about 0.03 mm to about 0.12 mm wherein the fiber preform is substantially free of a binder material and wherein the weighted-average fiber aspect ratio is correlated to a percent fiber volume fraction of the fiber preform based on the formula:

$$y=0.53944+0.13072\cdot x-0.025364\cdot x^2+0.0015561\cdot x^3-0.000040479\cdot x^4+0.00000038318\cdot x^5$$

where y is fiber volume fraction and x is aspect ratio (length:diameter).

2. The fiber preform of claim 1, wherein fibers comprise alumina silicate.

3. The fiber preform of claim 1, wherein the fibers comprise a ceramic.

4. The fiber preform of claim 1, wherein the preform has a percent fiber volume fraction of the fiber preform of about 15% to about 55%.

5. A method of manufacturing a discontinuous fiber preform, comprising:

mixing fibers and a polar solvent to form a slurry, wherein the slurry is substantially free of a binder material;

pouring the slurry into a mold tooling;

filtering the slurry to retain the fibers in the mold tooling, the fibers having random and isotropic orientation and being uniformly distributed in the fiber preform; and evaporating the remaining polar solvent from the fiber preform.

6. The method of claim 5, wherein the slurry comprises about 1 to about 40 parts of the polar solvent to about 1 part of fibers.

7. A discontinuous fiber preform manufactured by the method of claim 5.

8. The method of claim 5, wherein the fibers comprise a ceramic.

9. A method of manufacturing a discontinuous fiber-reinforced metal matrix composite (MMC), comprising:

mixing fibers and a polar solvent to form a slurry, wherein the slurry is substantially free of a binder material;

pouring the slurry into a mold tooling;

filtering the slurry to retain the fibers in the mold tooling;

evaporating the remaining polar solvent from the fibers, thereby creating a fiber preform having fibers with a random and isotropic orientation that are uniformly distributed in the fiber preform; and pressure-infiltrating the fiber preform with a metal.

10. The method of claim 9, wherein the metal comprises an A201 aluminum alloy.

11. The method of claim 9, wherein the slurry comprises about 1 to about 40 parts of the polar solvent to about 1 part of fibers.

12. A discontinuous fiber-reinforced metal matrix composite (MMC) manufactured by the method of claim 9.

13. The method of claim 9, wherein the metal is aluminum or an aluminum alloy.

14. The method of claim 9, wherein the fibers comprise a ceramic.

15. A fiber-reinforced metal matrix composite (MMC), comprising:

a metal matrix;

fibers having a weighted-average fiber length of about 0.03 mm to about 0.12 mm, the fibers having a random and isotropic orientation and being uniformly distributed in the metal matrix and wherein the weighted-average fiber aspect ratio is correlated to a percent fiber volume fraction of the fiber preform based on the formula:

$$y=0.53944+0.13072\cdot x-0.025364\cdot x^2+0.0015561\cdot x^3-0.000040479\cdot x^4+0.00000038318\cdot x^5$$

where y is fiber volume fraction and x is aspect ratio (length:diameter).

16. The fiber-reinforced metal matrix composite (MMC) of claim 15, wherein the metal matrix comprises an A201 aluminum alloy and the fibers are a 26% volume fraction of alumina-silicate fibers.

17. The fiber-reinforced metal matrix composite (MMC) of claim 15, wherein the fibers comprise alumina silicate.

18. The fiber-reinforced metal matrix composite (MMC) of claim 15, wherein the fibers comprise a ceramic and the metal comprises aluminum or an aluminum alloy.

19. A fiber-reinforced metal matrix composite (MMC) of claim 15, wherein the preform has a percent fiber volume fraction of the fiber preform of about 15% to about 55%.

* * * * *